US005815984A

United States Patent [19]

Sheets et al.

[11] Patent Number: 5,815,984

[45] Date of Patent: Oct. 6, 1998

[54] CASEMENT WINDOW OPERATOR

[75] Inventors: Benjamin L. Sheets, Rice Lake; Lavern L. Wintrone, Barron; Michael W. Kondratuk, Cameron, all of Wis.

[73] Assignee: Wright Products Corp., Minneapolis, Minn.

[21] Appl. No.: 624,885

[22] Filed: Mar. 27, 1996

[51] Int. Cl.[6] ..... E05D 7/06

[52] U.S. Cl. ..... 49/246; 49/341

[58] Field of Search ..... 292/263, 276, 292/20 D, 33 D, 338; 49/246, 247, 248, 249, 339, 340, 341, 342, 345

[56] References Cited

U.S. PATENT DOCUMENTS

| | | | |
|---|---|---|---|
| Re. 26,508 | 12/1968 | Stavenau et al. . | |
| Re. 34,230 | 4/1993 | Tucker et al. . | |
| Re. 34,287 | 6/1993 | Berner et al. . | |
| D. 347,569 | 6/1994 | Vetter et al. . | |
| D. 350,666 | 9/1994 | Wobschall et al. . | |
| 755,058 | 3/1904 | Shaw | 292/338 |
| 1,957,990 | 5/1934 | Austin | 49/340 |
| 2,674,452 | 4/1954 | Hummert . | |
| 3,032,330 | 5/1962 | Stavenau . | |
| 3,085,299 | 4/1963 | Reynaud . | |
| 3,214,157 | 10/1965 | Stavenau . | |
| 3,258,874 | 7/1966 | Martin . | |
| 3,422,575 | 1/1969 | Armstrong . | |
| 3,438,151 | 4/1969 | Evers et al. . | |
| 3,457,675 | 7/1969 | Armstrong . | |
| 3,461,609 | 8/1969 | Armstrong . | |
| 3,838,537 | 10/1974 | Stavenau et al. . | |
| 4,136,578 | 1/1979 | Van Klompenburg . | |
| 4,241,541 | 12/1980 | Van Klompenburg et al. . | |
| 4,253,276 | 3/1981 | Peterson et al. . | |
| 4,266,371 | 5/1981 | Erdman et al. . | |
| 4,305,228 | 12/1981 | Nelson . | |
| 4,346,372 | 8/1982 | Sandberg . | |
| 4,491,355 | 1/1985 | Marinoni | 292/263 |
| 4,521,993 | 6/1985 | Tacheny et al. . | |
| 4,617,758 | 10/1986 | Vetter . | |
| 4,823,508 | 4/1989 | Allen . | |
| 4,840,075 | 6/1989 | Tucker . | |
| 4,843,703 | 7/1989 | Nolte et al. . | |
| 4,845,830 | 7/1989 | Nolte et al. . | |
| 4,894,902 | 1/1990 | Tucker . | |
| 4,937,976 | 7/1990 | Tucker et al. . | |
| 4,945,678 | 8/1990 | Berner et al. . | |
| 5,054,239 | 10/1991 | Tucker et al. . | |
| 5,199,216 | 4/1993 | Vetter et al. . | |
| 5,272,837 | 12/1993 | Nolte et al. . | |

FOREIGN PATENT DOCUMENTS

| | | | |
|---|---|---|---|
| 356880 | 2/1938 | Italy | 49/345 |
| 55534 | 11/1943 | Netherlands | 49/341 |
| 481936 | 3/1938 | United Kingdom . | |
| 1299154 | 12/1972 | United Kingdom . | |
| 1501392 | 2/1978 | United Kingdom . | |

OTHER PUBLICATIONS

15/Entrygard® Dual Arm Operator brochure (pp.3.5 –3.5f) (1993).

Wright products Corp. © brochure: Split Arm Casement Operator (pp. 1–7) (1993).

Miscellaneous Window & Door Hardward accessories brochure (1 page) (1994).

*Primary Examiner*—Jerry Redman

*Attorney, Agent, or Firm*—Mechant, Gould, Smith, Edell, Welter & Schmidt

[57] ABSTRACT

A casement window operator includes a linkage with an extensible arm pivotally connecting to a driven arm mounting to the window frame. An extended end of the driven arm pivotally connects to a link mounting to the sash bracket on the pivoting sash. The extensible arm includes a screw drive member connected to a friction bearing of a cover. Rotation of the screw extends and retracts the cover to lengthen and shorten the extensible arm. The operator includes an actuator with a handle mounted to a first bevel gear intermeshing with a second bevel gear. The bevel gears are mounted in a housing which pivotally rotates as the linkage is actuated. The second bevel gear is coupled to the screw member of the extensible arm.

23 Claims, 14 Drawing Sheets

CASEMENT WINDOW OPERATOR

BACKGROUND OF THE INVENTION

1. Field of the Invention

The present invention is directed to a casement window operator, and in particular to an operator having a power-screw type drive.

2. Description of the Prior Art

Casement windows, which have a sash which pivots outward along a vertical edge, are well known. Operators for opening and closing the windows typically use a crank to actuate a linkage for pushing the window open and pulling it shut. Although the prior art actuators and linkages are able to open and close the window, there are several drawbacks to the operators.

Prior casement window operator linkages often suffer from window creep. It is desired that the casement window be locked at any position so that the window does not open or close further. The inability to remain fixed is defined as window creep. Creep can be caused by wind or other forces which may act against the window. To prevent unwanted opening or closure, it is desired to have a casement window which eliminates window creep. Another problem typically suffered by prior casement operators is backlash, defined as the movement at the end of an open casement window. Prior art operators typically utilize a worm and sector gear drive for actuation. These mechanisms typically use a short lever arm which amplifies the play in the worm and sector connection throughout the mechanism. It will be appreciated that tighter tolerances and an increased moment arm length within the mechanism significantly reduce window backlash.

Other problems associated with typical window casement operators are high manufacturing and installation costs. In particular, the installation costs can significantly increase the overall cost of the window when multiple windows are being installed. Many operators require several brackets mounting on the window sash, thereby increasing installation time and costs for bracket placement and screw installation.

Prior mechanisms also require significant input torque. In particular, at the extended or locking positions, input torque to fully close or open the window may become significant. For ease of operation, it is desired to reduce the amount of input torque. The mechanisms also require significant width for the linkage arms so that some windows require a sash width of at least 17 inches to mount the operator. A smaller operator would provide for use with a range of different size windows and provide for using a single operator rather than several types of operators depending on the size of the window.

It can be see then, that a new and improved casement window operator is needed. Such an operator should decrease the amount of input torque and eliminate and minimize window creep and backlash while maintaining a reasonable number of handle rotations for actuation. The operator should be adaptable to a variety of window sizes and should provide mounting holes which are accessible in a fully closed position for easier and faster installation. The present invention addresses these as well as others associated with casement window operators.

SUMMARY OF THE INVENTION

A first embodiment of the present invention is directed to a casement window operator and in particular to a power screw driven casement window operator.

The linkage for the casement window operator of the present invention includes an extensible driver arm which mounts from an actuator to a driven arm. The driven arm mounts from the window frame at one end and is connected at a mid-portion to the extensible arm. The extended end of the driven arm pivotally connects to a link which also pivotally connects to a sash bracket mounting to the sash. As the extensible driver arm is extended, the linkage pulls the sash bracket away from the pivot point of the sash to the frame, thereby opening the window. As the extensible arm is shortened, the sash bracket is pushed back toward the pivot point and the window closes.

The extensible driver arm includes a cover portion having a threaded nut member. The nut member engages a threaded drive screw member which also includes an exteriorly threaded portion and extends under the cover member when retracted. As the screw member is rotated relative to the cover and nut, the cover slides relative to the screw, thereby changing the length of the extensible arm. It can be appreciated that when the screw member is rotated in a first direction, the extensible arm will lengthen and when the screw member is rotated in a second direction, the extensible arm will shorten.

In one embodiment, the casement window operator includes a friction bearing engaging the screw drive member which acts to hold the operator in place to eliminate window creep. The friction bearing is a plastic bushing in the preferred embodiment which is self threading when attached to the screw member. However, nylon, rubber, ceramics and other friction applying materials could also be used.

The actuator portion includes a housing which forms a collar for receiving intermeshing bevel gears. The bevel gears are set at a substantially right angle to one another. The collars retain and align the gears so that there is little play between the gears. The first bevel gear is coupled to the drive screw member so that rotation of the gears also rotates the screw member and actuates the linkage. The second bevel gear includes a spindle extending therefrom. The spindle may be connected to a crank or other handle or directly coupled to an electric motor or other drive device to rotate the gears and actuate the linkage.

It can appreciated that when the drive screw member is retracted or extended, it experiences a slight angular displacement. According to the present invention, two embodiments accommodate this angular displacement, both retaining the substantially right-angle relationship between the first and second bevels. In the first embodiment, the drive screw member is integral with or rigidly coupled to the first bevel gear, and securely retained by a pivoting housing. Thus, the housing pivots in unison with any angular displacement of the drive screw member. In a second embodiment, the housing is rigidly mounted to the base of the window operator, and the drive screw member is rotatably coupled to the first bevel gear, for example, by a ball and socket. The opening in the housing through which the screw drive member extends is enlarged in order to permit, within a fixed range, angular displacement of the screw drive member apart from the housing or either of the bevel gears contained therein.

These and various other advantages and features of novelty which characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

BRIEF DESCRIPTION OF THE DRAWINGS

In the drawings, wherein like reference letters and numerals designate corresponding elements throughout the several views.

DETAILED DESCRIPTION OF THE PREFERRED EMBODIMENT(S)

Figure 1:
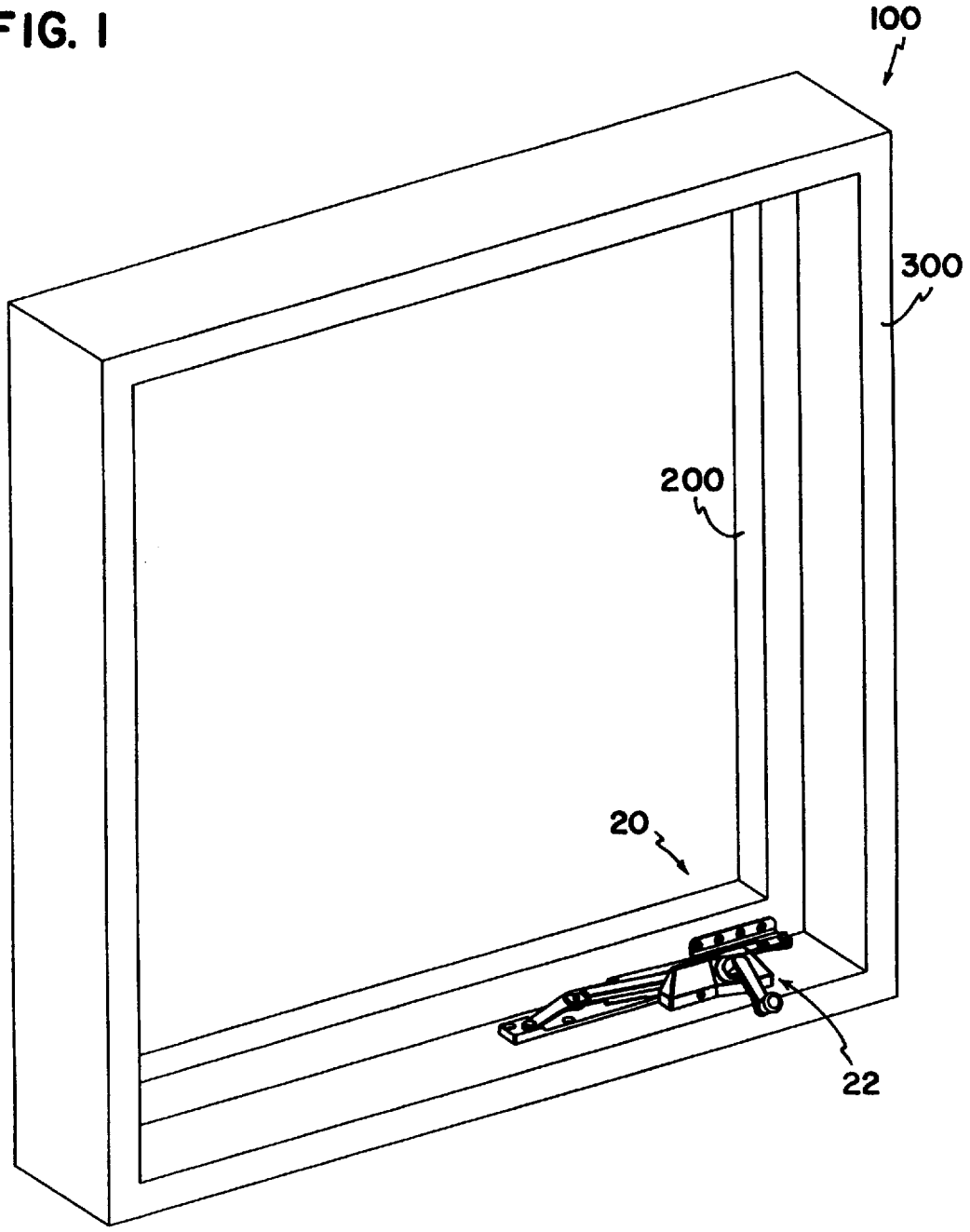
FIG. 1 shows a perspective view of a casement window having a first embodiment of an operator according to the principles of the present invention, with the window in a closed position.
Figure 2:
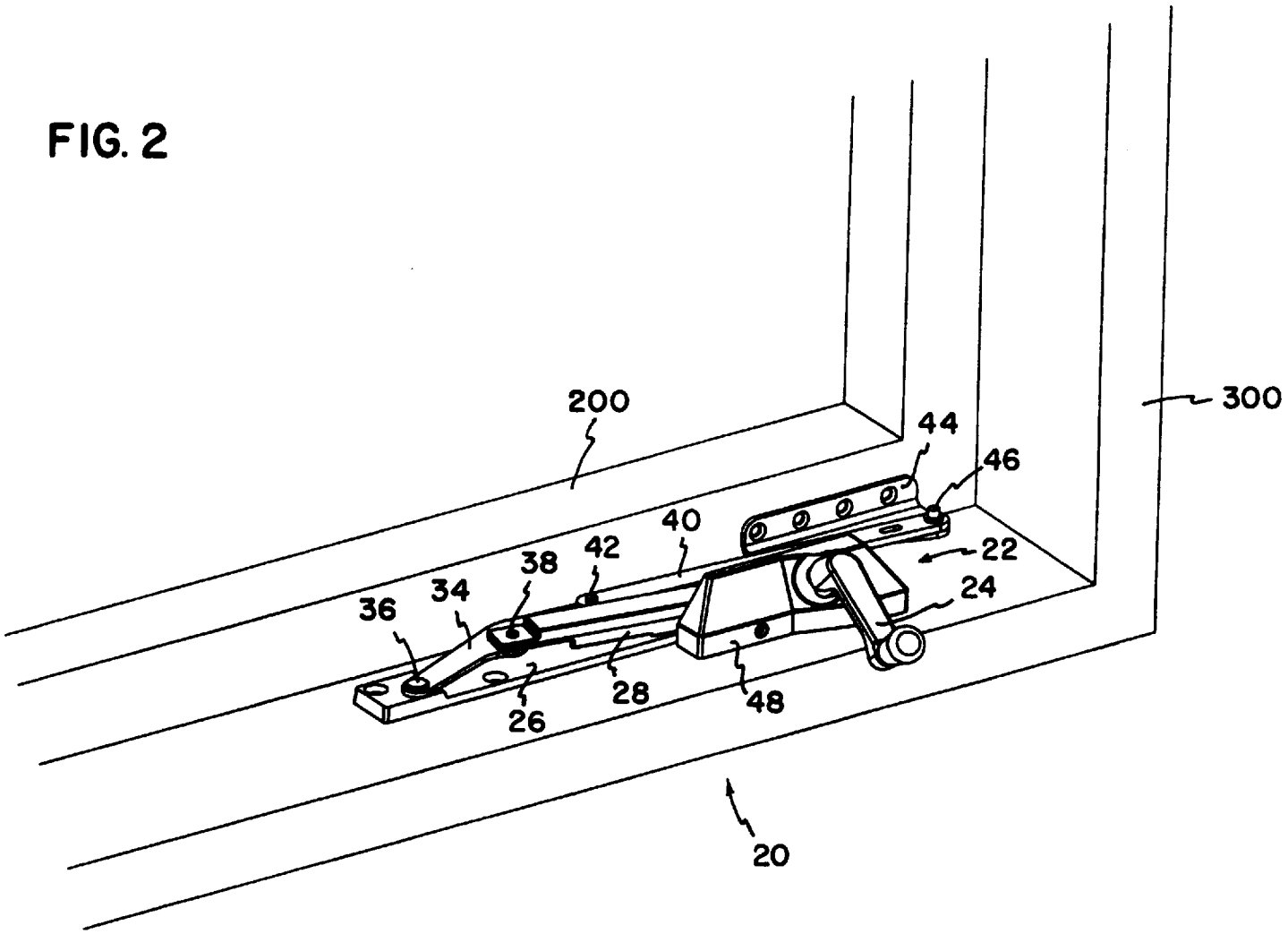
FIG. 2 shows a perspective view of the casement window operator shown in FIG. 1, with the window in a closed position.
Figure 3:
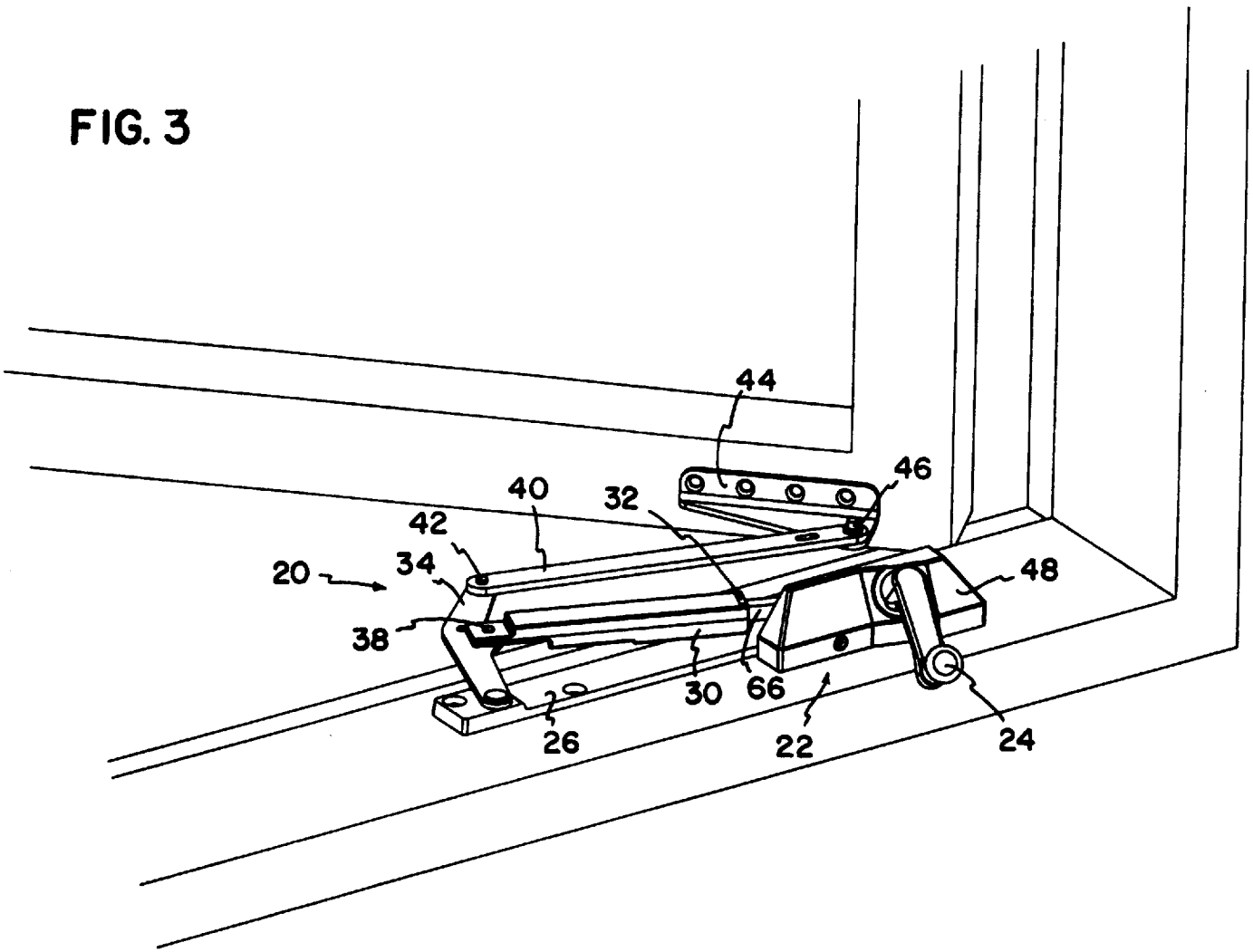
FIG. 3 shows a perspective view of the casement window operator shown in FIG. 1, with the window in a partially open position.
Figure 4:
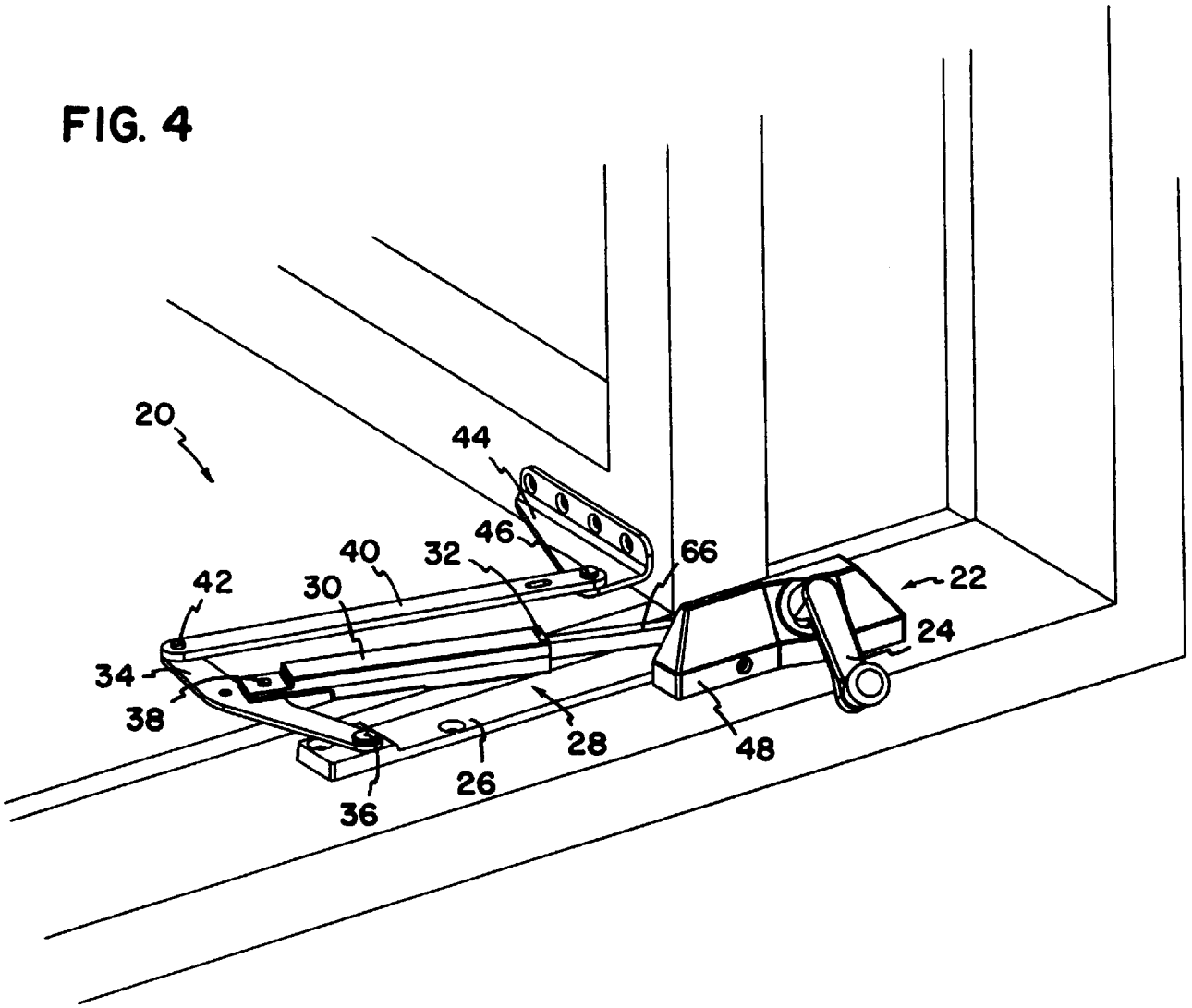
FIG. 4 shows a perspective view of the casement window operator shown in FIG. 1 with the window in a fully open position.

Referring now to the drawings, wherein like reference numerals designate corresponding structure throughout the views, and referring in particular to FIG. 1, there is shown a casement window generally designated 100, having a first embodiment of a casement window operator, generally designated 20. The window includes a sash 200 and a window jamb 300. The sash 200 and jamb 300 are pivotally connected to open and close, as shown in FIGS. 2–4. Referring now to FIG. 2, the casement window operator 20 includes an actuator 22 having a crank 24. The crank 24 rotates to open and close the window, through actuating the casement window operator 20, as explained hereinafter. The actuator 22 pivots about a base 26 mounted on the jamb 300. The actuator 22 interacts with an extensible power screw type driver arm 28 which connects to a driven arm 34 at a center pivot 38. The driven arm 34 pivotally connects at a first end 36 to the base 26. At an extended end 42, the driven arm 34 pivotally connects to a link 40. The link 40 connects to a sash bracket 44 at a pivotal connection 46 and the sash bracket 44 mounts to the window sash 200.

Figure 5:
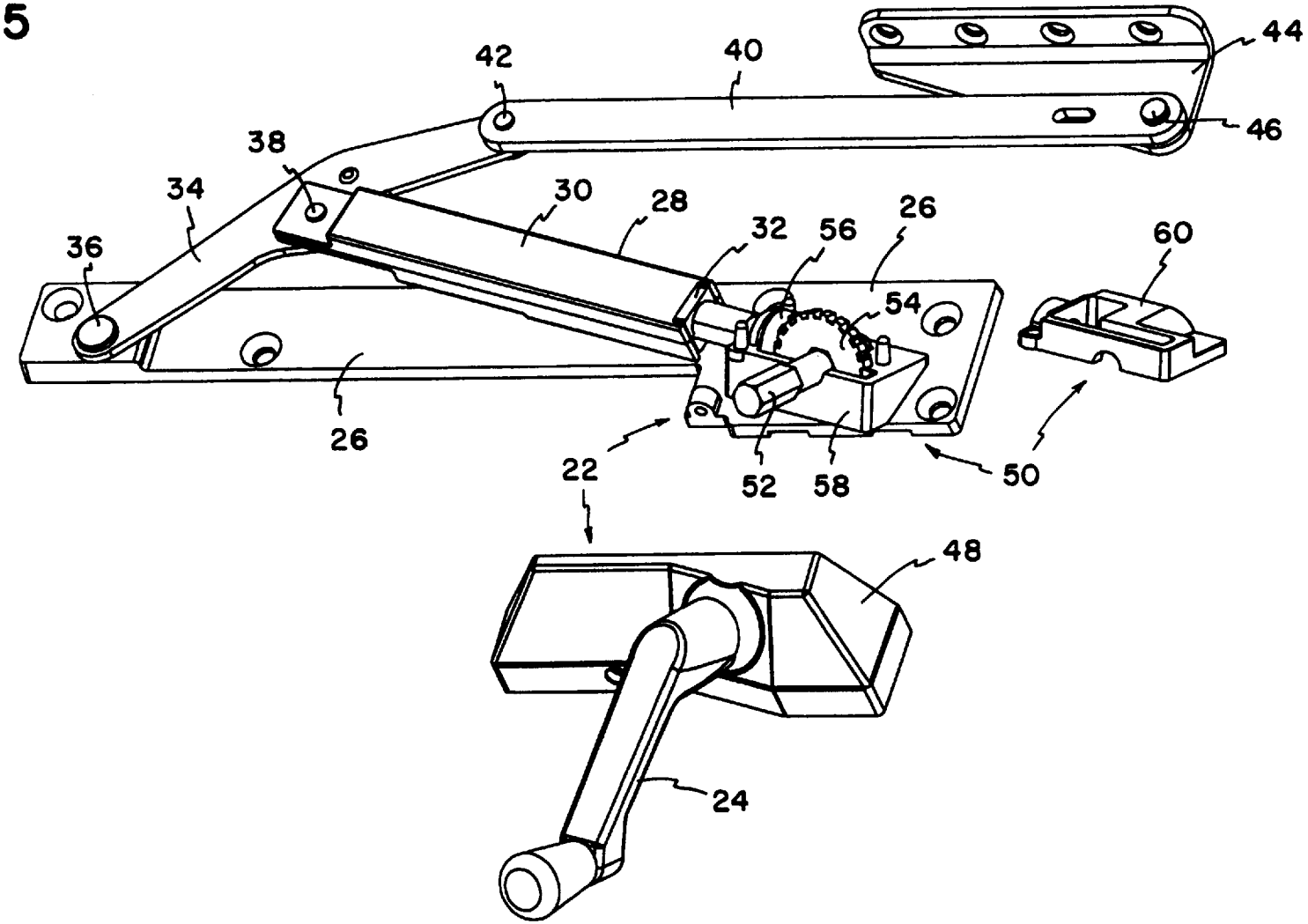
FIG. 5 shows a front perspective view of the casement window operator shown in FIG. 1 with the pivot assembly cap removed.
Figure 6:
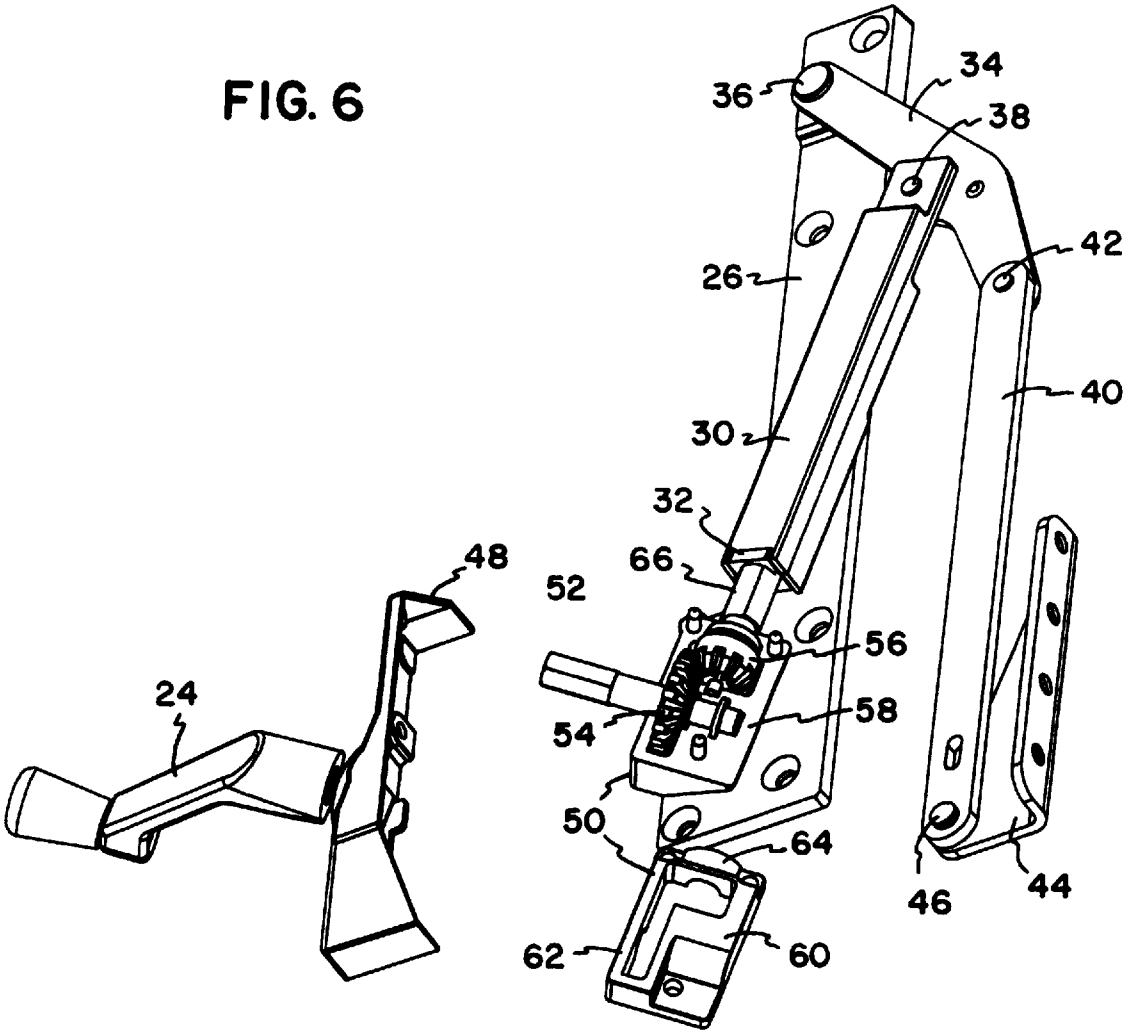
FIG. 6 shows a rear perspective view of the casement window operator shown in FIG. 1 with the pivot assembly cap removed.

The actuator 22 includes a housing 50 rotatably mounted on the base 26 and having a base 58, a cap 60 and a cover 48, which is more clearly shown in FIGS. 5 and 6. A spindle gear 54 and screw gear 56 are rotatably mounted and retained in the housing 50. The gears 54 and 56 are preferably bevel type gears which intermesh so that when the spindle gear 54 is rotated, the screw gear 56 rotates with it. In the preferred embodiment, the gear ratio is 2 to 1 so that for every rotation of the spindle gear 54, the screw gear 56 will rotate twice. A spindle 52 extends outward from the spindle gear 54 and attaches to the crank 24. Therefore, it can be appreciated that as the crank 24 is rotated, the screw gear 56 will also rotate. Typically, the crank 24 turns 13 or 14 rotations from fully closed to fully open or from fully open to fully closed. It can be appreciated that although a crank 24 is shown, other power inputs, such as electric motors or other drives may also be utilized to drive the spindle gear 54 or directly coupled to the driver arm 28.

The housing 50 forms a collar 62 for retaining the spindle gear 56 and a transversely mounted collar 64 for retaining the screw gear 54, as shown in FIGS. 5 and 6. It can be appreciated that when the housing cap 60 mounts to the base 58, the gears 54 and 56 are retained in an intermeshing relationship allowing free rotation of each of the gears. The screw gear 56 directly couples to a screw drive member 66. In a first embodiment, the housing 50 rotates angularly as the angular position of the screw drive member changes. The screw drive member 66 is preferably an exteriorly threaded member with a stub thread which forms a first end of the driver arm 28. In a preferred embodiment, the screw member 66 utilizes a thread with a pitch of 0.111, 9 threads per inch, a pitch diameter of 0.3265 inches, a major diameter of 0.375 inch, a minor diameter of 0.274 inches, a single thread depth of 0.0503 inches, a crest flat width of 0.0278 inches and a root flat width of 0.0252 inches. However, it can be appreciated that there may be other thread designs which also eliminate creep and help reduce backlash and have acceptable torque inputs and rotations for actuation.

Figure 7:
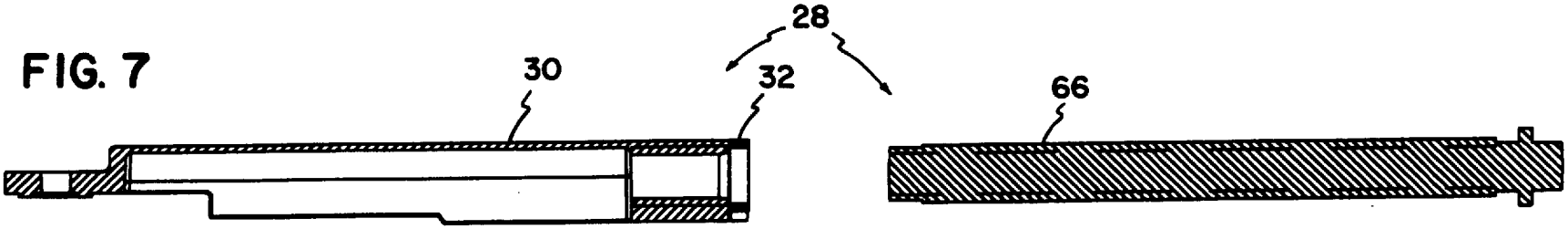
FIG. 7 shows an exploded sectional view of the screw and the nut and tube for the casement window operator shown in FIG. 1.

As shown in FIG. 7, the screw drive member 66 is configured for inserting under a cover 30 forming a second portion of the extensible driver arm 28. A friction bearing 32 acts as a nut which mounts in the first end of the cover member 30 and receives the screw member 66. In a preferred embodiment, the friction bearing 32 is a bushing made of a plastic material and is not threaded prior to assembly with the screw drive member 66. As the screw 66 is inserted through the friction bearing 32 during assembly, the screw member 66 threads the bearing 32. The friction bearing 32 slides into a slot in the cover member 30 and is retained at an end thereof. Therefore, as the screw 66 is rotated, the bearing 32 and the cover 30 will move axially relative to the screw. If the screw member 66 is rotated in a first direction, the cover member 30 will move axially to extend the arm 28. Rotation of the screw drive member 66 in a second direction moves the cover 30 in a second axial direction to retract the extensible driver arm 28. The friction bearing 32 also serves to wipe the threads of the screw member 66 clean, therefore assuring more reliable operation.

Figure 9:
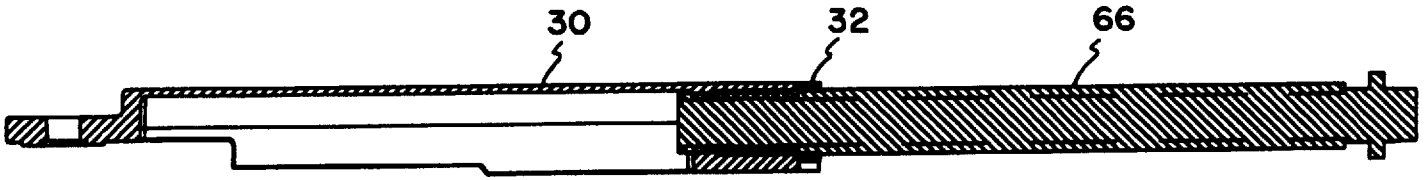
FIG. 9 shows a sectional view of the screw and the nut and tube shown in FIG. 6 in a partially extended position.
Figure 8:
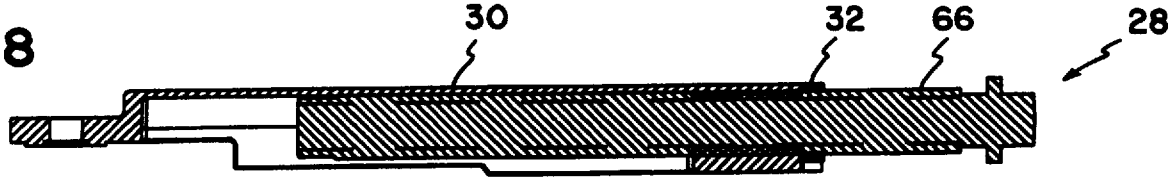
FIG. 8 shows a sectional view of the screw and the nut and tube shown in FIG. 6 in a retracted position.
Figure 10:
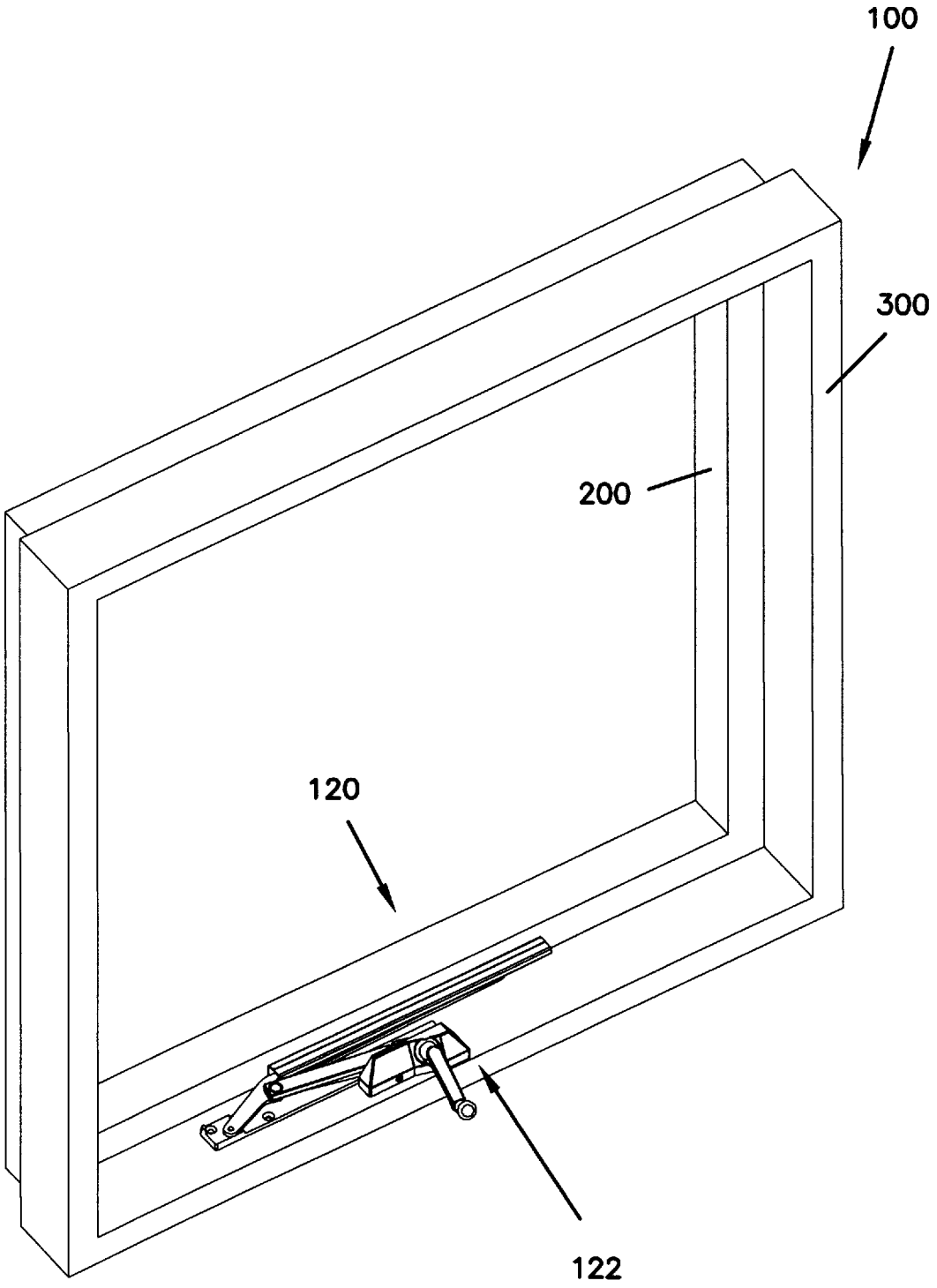
FIG. 10 shows a perspective view of a casement window having a second embodiment of an operator according to the principles of the present invention, with the window in a closed position.

As shown in FIGS. 8 and 9, the screw member 66 moves relative to the cover 30 and the friction bearing 32 of the extensible arm 28. In the retracted position shown in FIG. 8, the screw member 66 extends substantially under the cover 30. In this position, the extensible arm 28 is substantially retracted. However, as shown in FIG. 9, the screw member 66 extends only partially under the cover 30 and a substantial portion extends outward beyond the cover 30, thereby lengthening the arm 28 and partially opening the window, as explained hereinafter. It can be appreciated that as more of the screw 66 extends beyond the cover 30 of the extensible arm 28, the window 100 opens further.

Referring again to FIGS. 2–4, and in particular to FIG. 2, the window is shown in a closed position. At this position, the extensible arm 28 is retracted, thereby pulling the driven arm 34 inward. This pushes the link 40 towards the pivot of the window sash. The sash bracket 44 is pushed by the link 40 sufficiently inward to substantially close the window 100. In the substantially closed position, sash locks (not shown) are utilized to obtain a tight closure and seal between the sash 200 and the jamb 300. As shown in FIG. 3, by rotation of the crank 24, the extensible arm 28 is lengthened. This motion pushes the driven arm 34 away from the pivot between the sash 200 and jamb 300. The pivot arm 34 pulls the link 40 away from the pivot, thereby pulling the sash bracket 44 away from the window pivot and pulling the sash bracket 44 outward, thereby partially opening the window. Further movement fully extends the arm 28 and pushes the pivot arm 34 still further away from the pivot between the sash 200 and jamb 300. The end of the driven arm 34 pulls the link 40 and the sash bracket 44 further outward and pivots the window to a fully open position. Reversing the direction of the crank will move the window from the open position shown in FIG. 4 back to a closed position shown in FIG. 2.

With the configuration of the operator 20, the perpendicular distance between the driver arm torque vector extending through the pivot of base 58 and the driver arm center pivot 38, and the driven arm pivot 36 determines the moment distance about the pivot 36. With the present arrangement, the distance does not decrease substantially, so that the movement applied to the driven arm 34 does not increase or decrease a great amount and since a longer moment distance is maintained, backlash is reduced. It can also be appreciated that the power screw type driver arm 28 provides increased torque over worm and sector gear arrangements and may be used with other linkages.

The overlapping design and the relative position between the base 26 and the actuator links 28, 34 and 40 of the present invention require relatively little length along the window frame 300. In the embodiment shown, the operator 20 functions well with window widths as narrow as 12 inches. It can also be appreciated that with the present invention, the base 26 includes hardware mounting holes which are all accessible when the operator 20 is in the closed position. With this configuration, all of the screws can be secured and the base 26 mounted without having to actuate the operator.

The direct interaction of the gears 54 and 56 and the moment applied by the driver arm 28 through the driver arm 34 provide for lower power input and easy operation. In addition, the interaction of the bevel gears 54 and 56 along with the drive screw 66 and cover 30 develop very little extra play so that backlash is substantially decreased. In addition, the friction bearing 32 interacting with the threaded screw drive member 66 with a self-locking thread design holds the operator 20 at any position in either static load conditions or cyclical load conditions from wind and other forces so that window creep is eliminated.

A second embodiment of an operator incorporating the principles of the present invention is illustrated in FIGS. 10–16. As shown more clearly in FIGS. 12 and 13, an operator 120 is mounted on the window 100 which opens in an opposite direction than the window depicted in FIGS. 1–4. It can be appreciated, however, that both operator embodiments can be used on windows that open from the left or from the right. It is also to be understood that, although the second embodiment has a slightly different configuration, it offers the advantages mentioned above with respect to the first embodiment.

Figure 11:
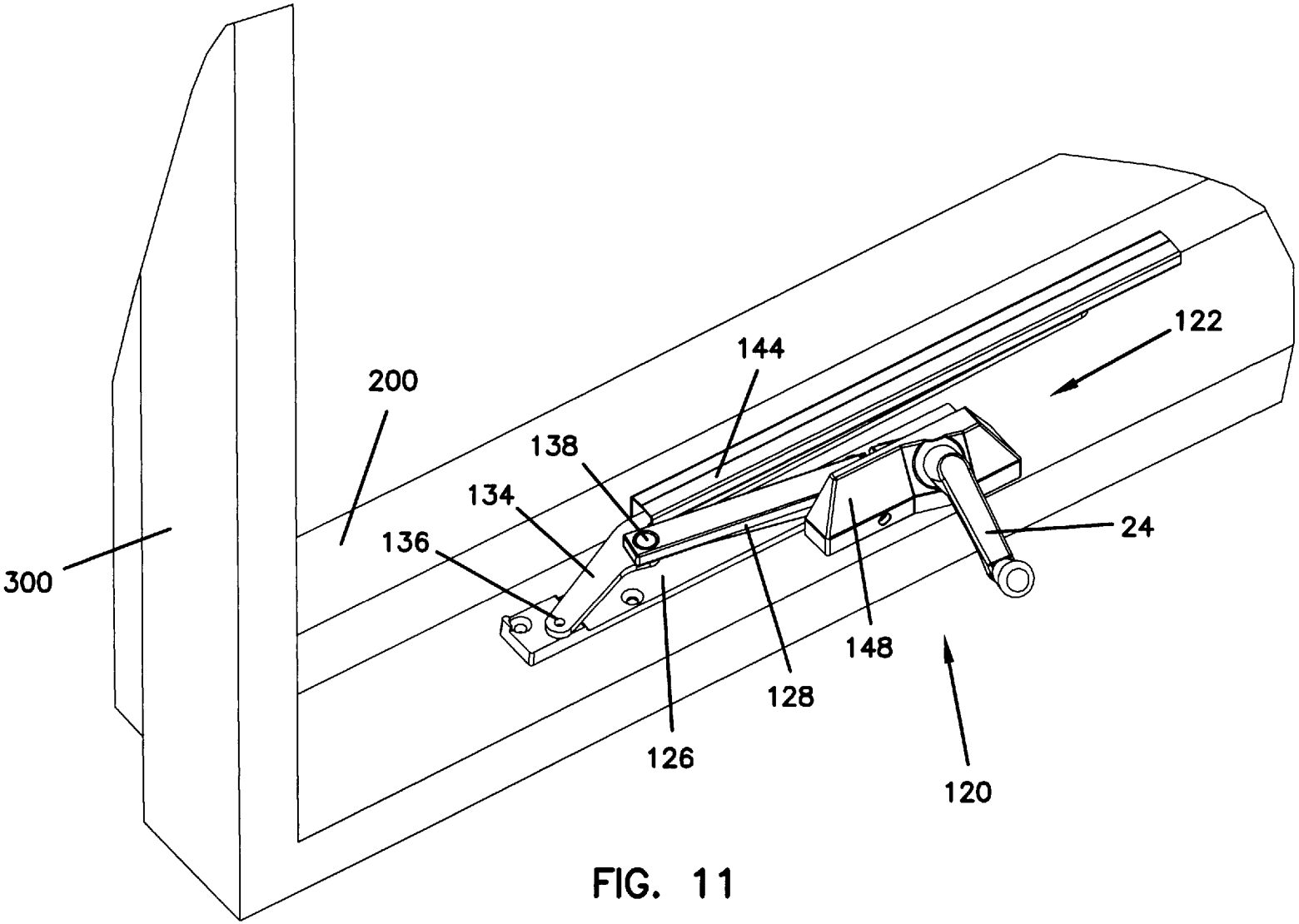
FIG. 11 shows a perspective view of the casement window operator shown in FIG. 10, with the window in the closed position.
Figure 12:
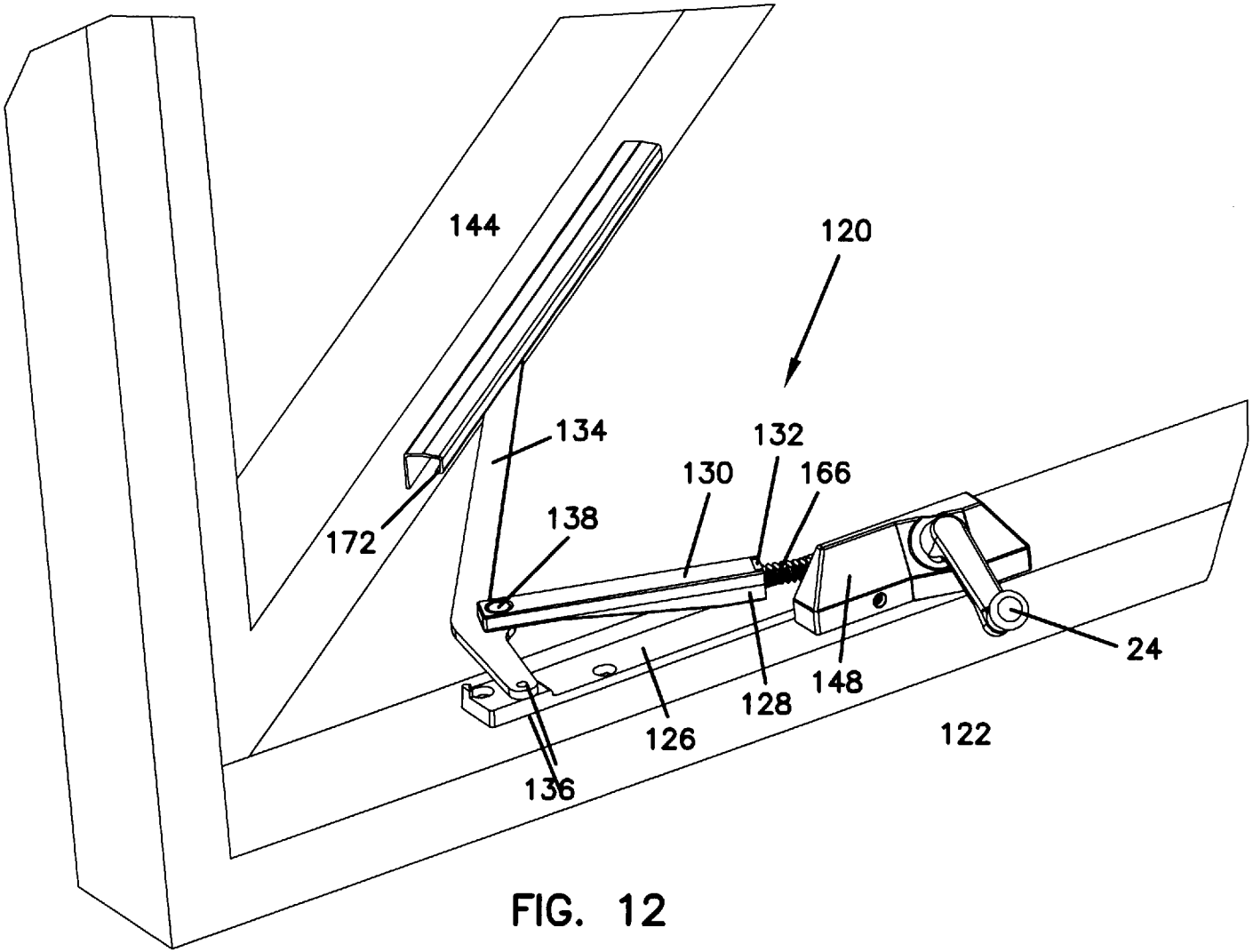
FIG. 12 shows a perspective view of the casement window operator shown in FIG. 10, with the window in the partially open position.
Figure 13:
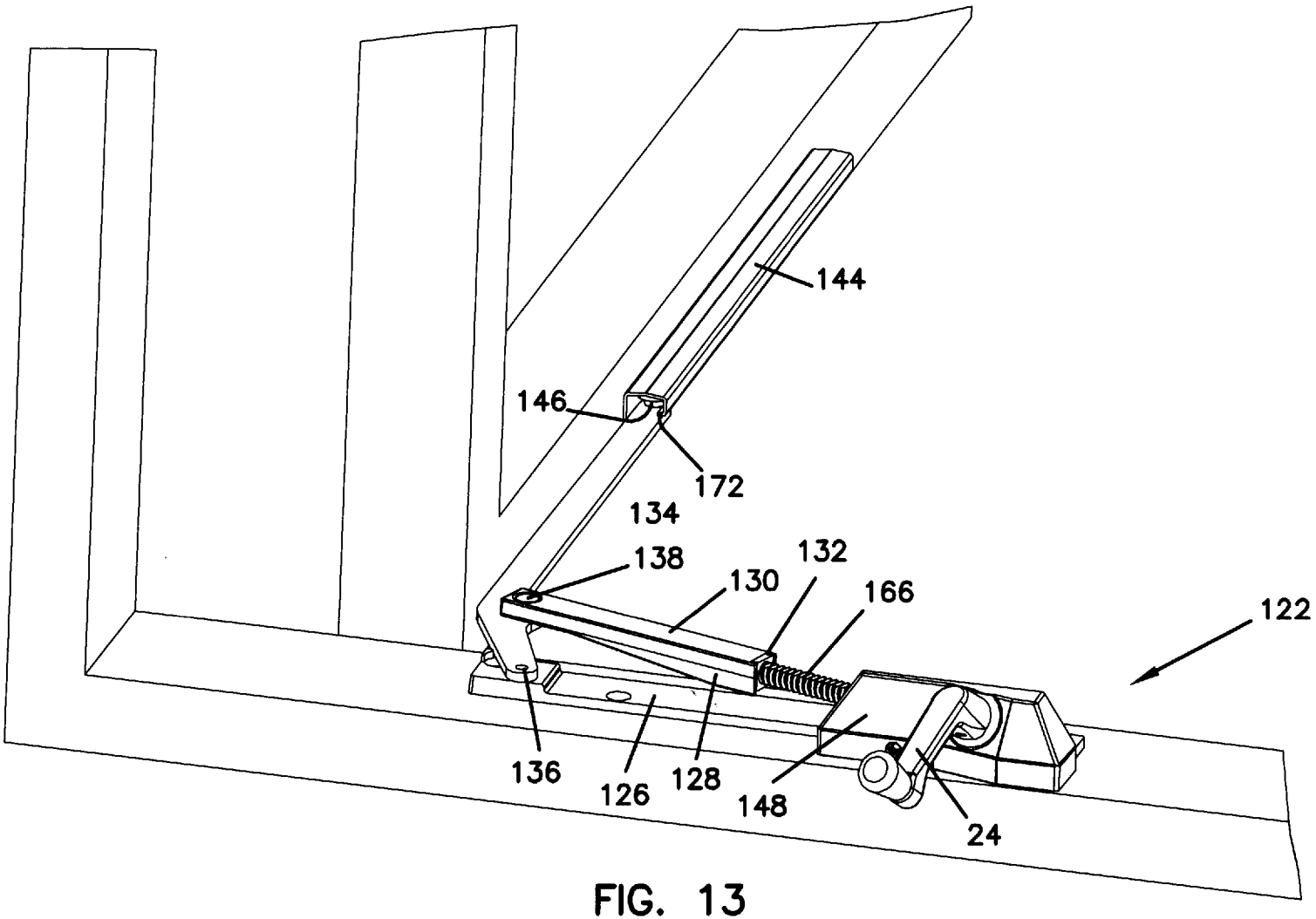
FIG. 13 shows a perspective view of the casement window operator shown in FIG. 10, with the window in a fully open position.

Referring now to FIGS. 11–13, the casement window operator 120 includes an actuator 122 having a crank 24 which can be rotated to open and close the window 100. The actuator 122 is fixedly mounted to a base 126 of the operator 120 which in turn is mounted to the sash 200 of the window 100. The actuator 122 interacts with an extensible power screw driver arm 128 which connects to a driven arm 134 at a center pivot 138. The driven arm 134 pivotally connects at a first end 136 to the base 126. A second end of the driven arm 134 includes an outwardly extending circular follower 146. As seen most clearly in FIG. 13, the follower 146 includes a ridge which slidably engages a sash bracket 144 that is mounted to the window sash 200. The follower 146 slides along a channel formed in the sash bracket 144 when the extensible driver arm 128 is extended or retracted, thereby opening or closing the window 100.

Figure 14:
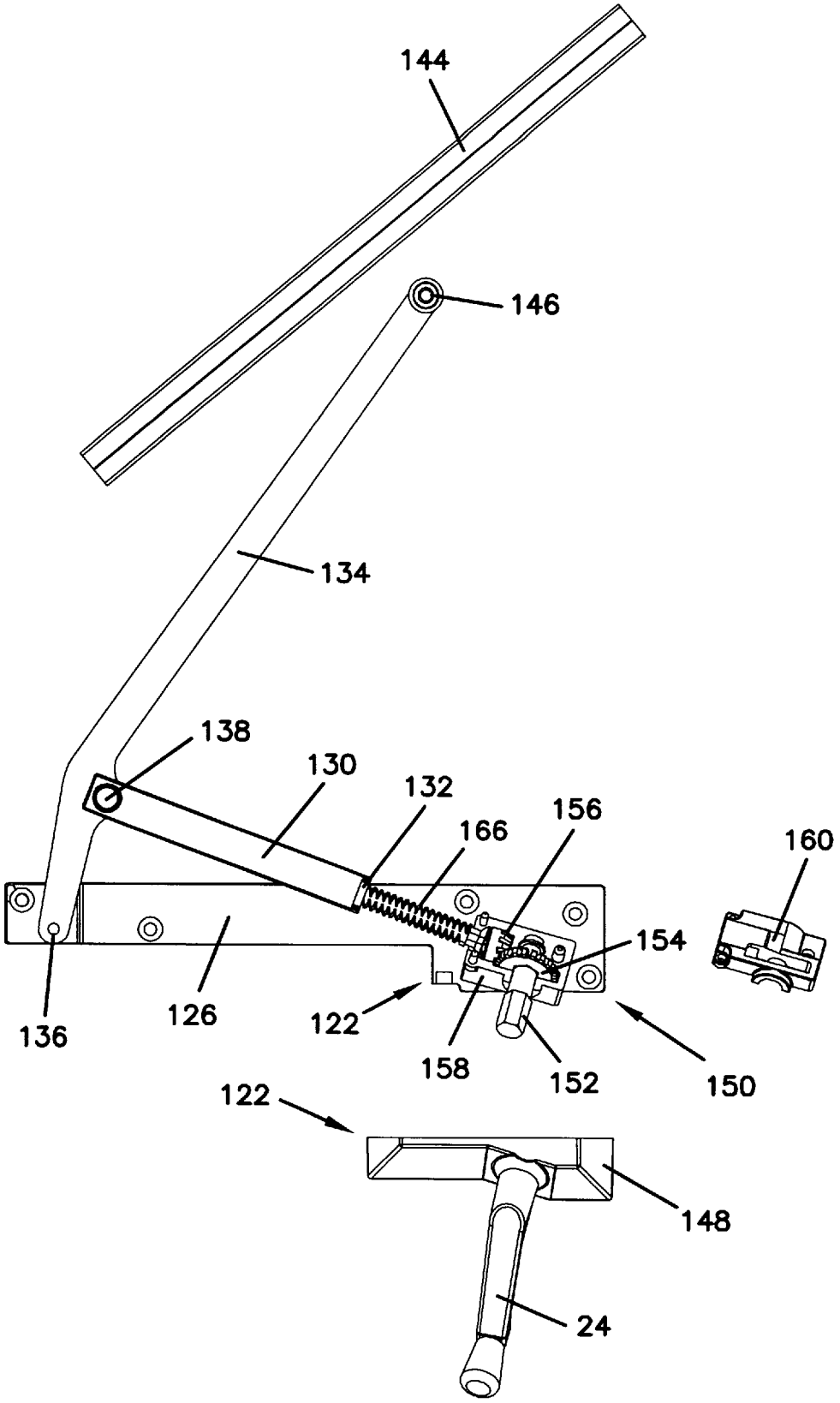
FIG. 14 shows a front perspective view of the casement window operator shown in FIG. 10, with the fixed assembly cap removed.

As shown in FIG. 14, the actuator 122 of the second embodiment has many of the same elements as the first embodiment. The actuator 122 includes a housing 150 having a base 158, a cap 160, a cover 148, and two intermeshing bevel gears 154 and 156 retained therein which are coupled to a crank 24 and a threaded member 166, respectively.

Unlike the first embodiment, however, the housing 150 in the second embodiment is rigidly mounted to the base 126 of the operator 120. Since the housing 150 does not pivot as in the first embodiment, the actuator 122 of the second embodiment incorporates two features which accommodate the slight angular movement of the threaded member 166 when it is extended or retracted. First, the threaded member 166 includes a ball and socket joint 168 which rotatably couples the threaded member 166 to the screw gear 156. The ball and socket joint 168 enables the threaded member 166 to angularly rotate without disrupting the intermeshing relationship of the bevel gears 154 and 156. Second, an opening 170 in the housing 150 through which the threaded member 166 extends is slightly enlarged in order to permit, within a fixed range, the angular displacement of the threaded member 166.

Figure 15:
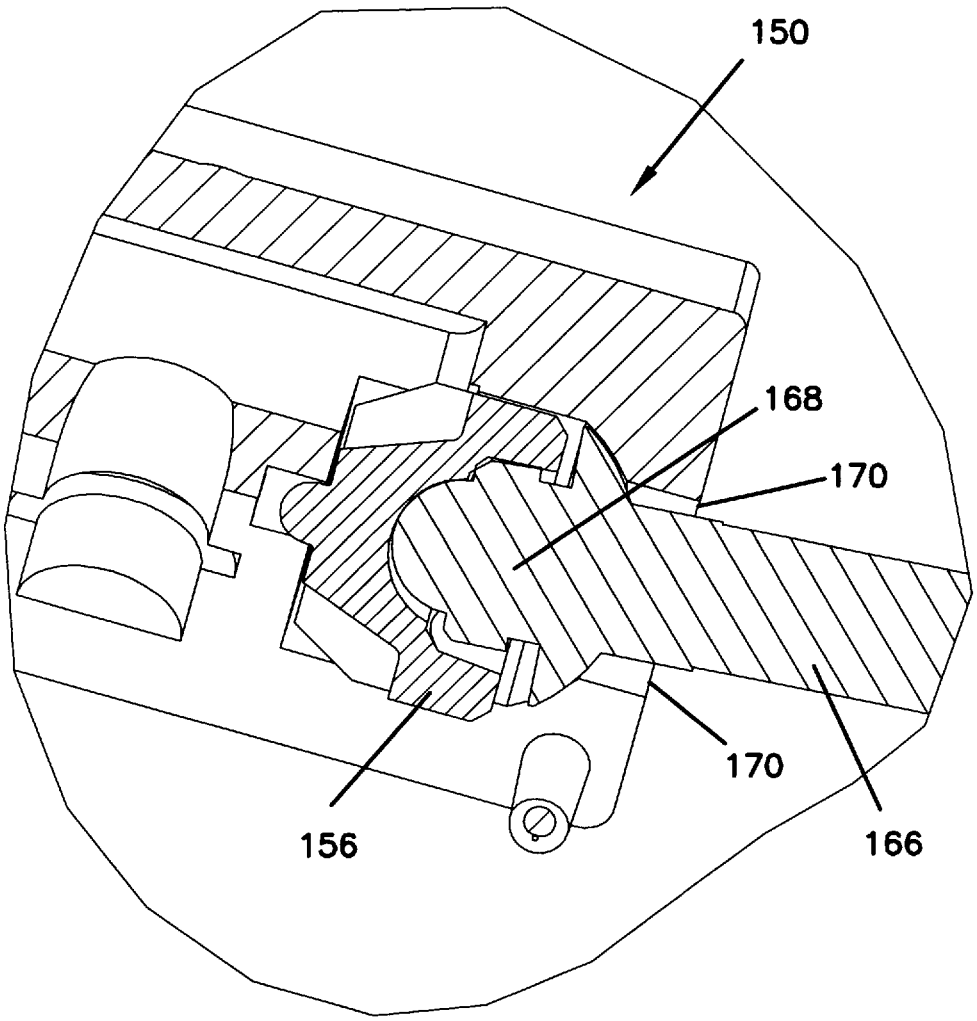
FIG. 15 shows an exploded cross-sectional view of the ball and socket portion of the screw for a casement window operator shown in FIG. 10 when the window is in a partially open position; and, FIG. 16 shows an exploded cross-sectional view of the ball and socket portion of the screw for a casement window operator shown in FIG. 10 when the threaded member is at its maximum angular displacement.
Figure 16:
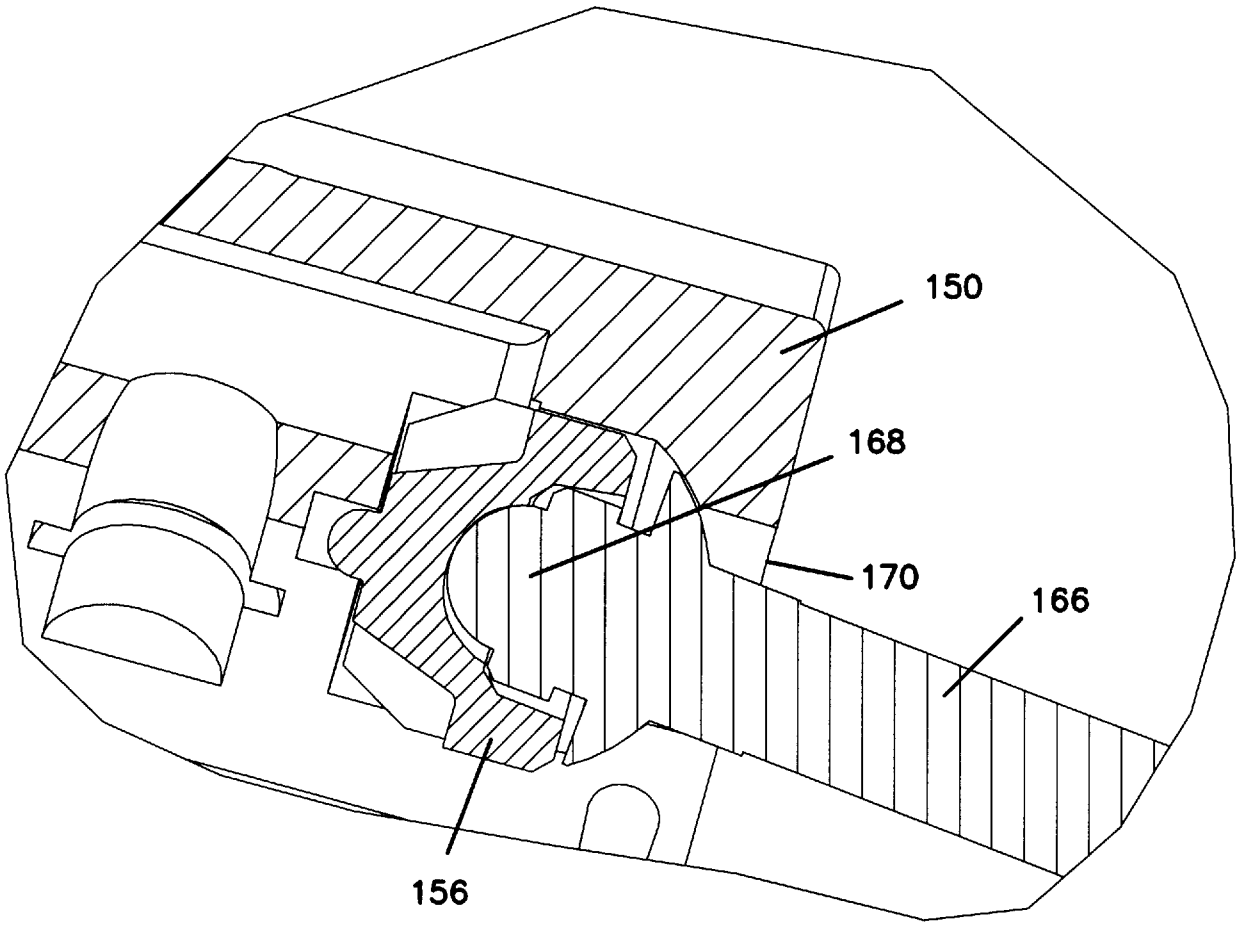

FIGS. 15 and 16 most clearly illustrate how the second embodiment accommodates the slight angular displacement of the threaded member 166. The threaded member 166, which includes a ball and socket joint 168 that remains coupled to the screw gear 154 throughout the entire range of angular displacement, extends though the opening 170 in the housing 150. The opening 170 in the housing 150, seen most clearly in FIG. 15, represents the range of angular displacement that the threaded member 166 undergoes when the window 100 moves between a closed and a completely open position. In FIG. 15, the window (not shown) is in a partially open position as the threaded member 166 is not engaging either side of the opening 170 in the housing 150. In FIG. 16, the threaded member 166 abuts one of the sides of the opening 170, illustrating the orientation of the threaded member 166 at its maximum angular displacement, wherein the center pivot 138 is at a maximum distance from the base 126. As the driver arm 128 extends further, the screw member 166 moves angularly back toward the base 126. It is recognized that although the threaded member 166 undergoes angular displacement, the ball and socket joint remains coupled to the screw gear 156 at all times.

Another variation in the second embodiment is the manner in which the operator 120 connects to the window sash 200. As depicted in FIGS. 11–13, the sash bracket 144 is mounted to the sash 200 of the window 100 and defines a channel with a ledge 172 for receiving the follower 146 on the driven arm 134. The ridge on the follower 146 travels along the sash bracket 144 above the ledge 172 of the sash bracket 144. When the driven arm 134 is extended or retracted, the follower 146 slides along the channel atop the ledge 172, thereby effectuating the opening or closing of the window 100. The location of the follower 146 within the channel depends on the degree to which the window 100 is open or closed.

As described in connection with the two embodiments, the present invention includes two different actuators and two different arm arrangements for linking an operator to the sash of a window. Although not depicted in the drawings, it is to be understood that each of the actuators can be used with either arm arrangement or other arm arrangements well known in the art.

It is to be understood that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. An operator apparatus in combination with a casement window, the window having a window frame and a pivoting sash, the apparatus comprising:

a housing rotatably mounted to the window frame;

first and second intermeshing bevel gears rotatably mounted in the housing;

a spindle member extending from the first bevel gear;

an elongated threaded screw member coupled to the second bevel gear;

a first arm member having an internally threaded portion engaging the elongated threaded member, wherein rotation of the elongated screw member in a first direction retracts the first arm member and rotation in a second direction extends the first arm member; and, a driven arm pivotally mounted to an extended end of the first arm member.

2. A casement window and operator according to claim 1, wherein the driven arm is configured for pivotally connecting to the window sash.

3. A casement window and operator according to claim 2, wherein the friction bearing comprises a plastic member engaging the threaded portion of the elongated threaded member.

4. A casement window and operator according to claim 1, wherein the threaded member includes a sixty degree stub thread.

5. A casement window and operator according to claim 1, wherein the housing mounts on a base and the base includes mounting holes formed therein configured for mounting to the window frame, and wherein all of the mounting holes are accessible when the operator is in a retracted position.

6. A casement window and operator according to claim 1, further comprising a crank handle attached to the spindle.

7. A casement window and an operator for the casement window, the window having a frame and a pivoting sash, the operator comprising:

means for providing torque having:

a housing rigidly mounted to the casement window frame;

a spindle gear rotatably mounted on the housing;

a spindle rotatably mounted on the housing and coupled to the spindle gear to rotate with the spindle gear;

a screw gear mating with the spindle gear, wherein the screw gear is angularly rotatable within a fixed range and rotatably coupled to the threaded screw member;

a threaded screw member coupled to the means for providing torque;

a threaded nut-type member engaging the threaded screw member, whereby rotation of the threaded screw member in a first direction extends the threaded screw member relative to the nut-type member, and rotation of the threaded screw member in a second direction retracts the threaded screw member relative to the nut-type member; and a driven arm pivotally connected to the nut-type member.

8. A casement window and operator according to claim 7, wherein the housing is configured for rotatably mounting to the window frame.

9. A casement window and operator according to claim 8, wherein the spindle gear and screw gear comprise bevel gears.

10. A casement window and operator according to claim 8, wherein the threaded screw member is retained by the housing.

11. A casement window and operator according to claim 8, wherein the housing forms retaining collars for retaining and positioning the spindle gear and the screw gear.

12. A casement window and operator according to claim 7, wherein the nut-type member further comprises an elongate tube having an extended end pivotally connecting to the driven arm and the tube defines a recess receiving a retracted portion of the threaded screw member.

13. A casement window and operator according to claim 7, the operator further including a base configured for mounting to the window frame, wherein the housing is integrally formed with the base.

14. A casement window and operator according to claim 7, wherein the threaded screw member includes a ball and socket joint coupling to the screw gear.

15. A casement window and operator according to claim 14, wherein the housing includes an opening formed therein, and wherein the threaded screw member extends from the housing through the opening which corresponds in width to the range in which the threaded screw member is angularly rotatable.

16. A casement window and operator according to claim 15, wherein the housing forms a retaining collar for retaining and positioning the spindle gear.

17. A casement window and an operator apparatus the window having a window frame and a pivoting sash, the apparatus comprising:

a housing mounted to the window frame;

first and second intermeshing bevel gears rotatably mounted in the housing;

a spindle member extending from the first bevel gear;

an elongated threaded screw member rotatably coupled to the second bevel gear and angularly rotatable within a fixed range;

a first arm member having an internally threaded portion engaging the elongated member, wherein rotation of the elongated member in a first direction retracts the first arm member and rotation in a second direction extends the first arm member; and, a driven arm pivotally mounted to an extended end of the first arm member.

18. A casement window and operator according to claim 17, wherein the elongated member includes a ball and socket joint coupling to the second bevel gear.

19. A casement window and operator according to claim 18, wherein the housing includes an opening formed therein, and wherein the elongated member extends from the housing through the opening which corresponds in width to the range in which the elongated member is angularly rotatable.

20. A casement window and an operator apparatus, the window having a window frame and a pivoting sash, the apparatus comprising:

a housing rotatably mounted to the window frame;

first and second intermeshing bevel gears rotatably mounted in the housing;

a spindle member extending from the first bevel gear;

an elongated threaded screw member coupled to the second bevel gear;

a first arm member having an internally threaded portion engaging the elongated member, wherein rotation of the elongated member in a first direction retracts the first arm member and rotation in a second direction extends the first arm member; and, a driven arm pivotally mounted to an extended end of the first arm member.

21. A casement window and operator apparatus according to claim 20, wherein the housing mounts on a base and the base includes mounting holes formed therein configured for mounting to the window frame, and wherein all of the mounting holes are accessible in a retracted position for closing the window.

22. A casement window operator according to claim 20, further comprising a removable crank handle attached to the spindle.

23. A casement window and an operator apparatus, the window having a frame and a pivoting sash, the apparatus comprising:

means for providing torque having:

a housing rotatably mounted to the casement window frame;

a spindle gear rotatably mounted on the housing:

a spindle rotatably mounted on the housing and coupled to the spindle gear to rotate with the spindle gear;

a screw gear mating with the spindle gear, wherein the screw gear is coupled to the threaded screw member;

a threaded screw drive member coupled to the means for providing torque;

a threaded nut-type member engaging the threaded screw member, whereby rotation of the threaded screw member in a first direction extends the threaded screw member relative to the nut-type member, and rotation of the threaded screw member in a second direction retracts the screw member relative to the nut-type member; and a driven arm pivotally connected to the nut-type member.

* * * * *